United States Patent [19]

Jordan

[11] 4,046,340

[45] Sept. 6, 1977

[54] BOX TOP KITE, AND METHOD OF MAKING SAME

[76] Inventor: John W. Jordan, 208 Wellington, Houston, Tex. 77076

[21] Appl. No.: 766,768

[22] Filed: Feb. 7, 1977

[51] Int. Cl.[2] ..... B64C 31/06

[52] U.S. Cl. ..... 244/153 R; D34/15 AF

[58] Field of Search ..... 244/153 R, 155 R, 155 A; D34/15 AF

[56] References Cited

U.S. PATENT DOCUMENTS 1,214,592 2/1917 Roa ..... 244/153 R

FOREIGN PATENT DOCUMENTS 580,591 8/1959 Canada ..... 244/153 R

*Primary Examiner*—Trygve M. Blix
*Assistant Examiner*—Barry L. Kelmachter
*Attorney, Agent, or Firm*—Ranseler O. Wyatt

[57] ABSTRACT

A kite made out of a box top of the type of box formed of a light weight rigid plastic foam material, such as the substantially rectangular Polystyrene boxes used in dispensing hot food, particularly the type of such boxes having tops provided with a peripheral lip and a longitudinal slot in one longitudinal lip, midway of the ends of the box. A 1 inch tape, such as the tape commonly known as Engineer's flagging, of approximately 30 feet in length, is secured to the box top for a tail and a pigtail, and a string is attached to the flagging on the opposite side of the box top and the kite is ready to fly.

5 Claims, 4 Drawing Figures

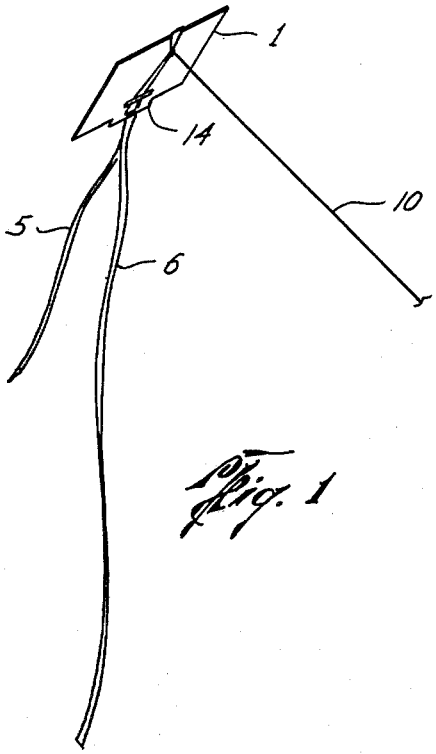
Fig. 1
Fig. 2
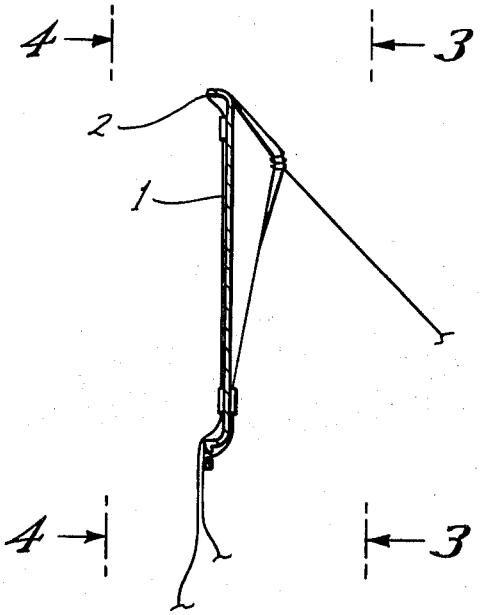
Fig. 3
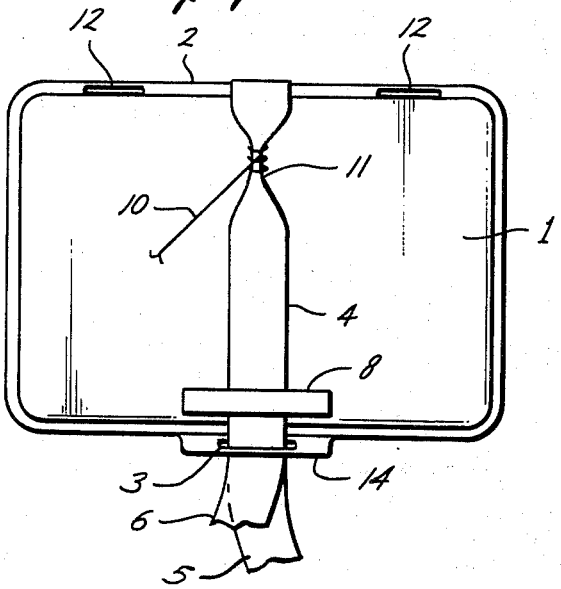
Fig. 4
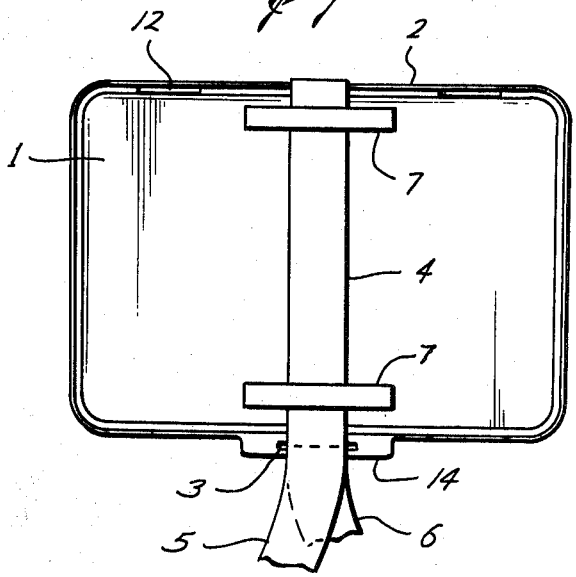

BOX TOP KITE, AND METHOD OF MAKING SAME

BACKGROUND OF THE INVENTION

Kites are always popular with children, as well as many adults, and many are made at home by children, who, in particular, have difficulty mounting sticks in the right places for the proper rigidity, and in correctly positioning and building the harness that makes flying possible. It is an object of this invention to provide a kite of inexpensive manufacture which can be made out of otherwise discarded items, and the construction of which is so simple it may be readily assembled by children, as well as adults, without tools and without having to deal with sticks or with a harness, and at a cost of about 8 cents.

SUMMARY OF THE INVENTION

A kite made from a box top being substantially rectangular, and having a tail and a pig tail extending from one surface and a string extending from the other surface, and the method of making a box top kite consisting of removing the top of a substantially rectangular plastic foam box, wrapping one end of a length of flagging around said top midway of the longitudinal ends, securing the flagging adjacent one peripheral margin, to the surface of the box top at a position where the pig tail of approximately 5 feet and the balance of the flagging, as a tail, extends from the surface of the top, then taping the flagging on the same surface of the top adjacent the opposing side margin, leaving the flagging loose, with approximately 2 inches of slack on the opposing surface of the box top, anchored adjacent one margin, and tying a string to the flagging at about the two thirds point from the anchor in said slack.

BRIEF DESCRIPTION OF THE DRAWING

FIG. 1 is an elevational perspective view of the kite in flight.

FIG. 2 is an enlarged cross sectional view, of a side elevation.

FIG. 3 is an enlarged front elevation, taken on the line 3—3 of FIG. 2, and

FIG. 4 is an enlarged back elevation, taken on the line 4—4 of FIG. 2.

DESCRIPTION OF THE PREFERRED EMBODIMENT

In the drawings, the numeral 1 designates a substantially rectangular rigid member which may be a box top of polystyrene, or the like, having a peripheral lip 2 and a longitudinal slot 3 in said lip 2, midway its ends. A flagging, such as the standard type of Engineer's flagging, 4 of approximately 30 feet in length and 1 inch wide, is secured to the member 1 by wrapping a portion of the flagging around the member, midway its longitudinal ends, and passing the end of the flagging through the slot 3, leaving a pig tail 5 of flagging of about 5 feet and the remainder 6 forming the tail of the kite. The flagging is secured to the member 1 by placing strips of adhesive tape 7, 7 across the flagging adjacent each peripheral margin of the box top, after pulling the flagging tight on the surface of the member 1, then placing a strip of adhesive tape 8 across the flagging on the opposite surface, adjacent the margin of the box top through which the tail extends, leaving the flagging slack on this last mentioned surface, so that it may be drawn about 3 inches from the said surface.

The stability of the kite in flight may be determined by the length of the pig tail 5. For steady flight, the length of the pig tail 5 is increased until the stability desired has been attained; for more acrobatic flight, where loops and the like are to be performed, the length of the pig tail 5 is decreased, making the tail 6 longer. The flagging being in a continuous piece, such adjustments are simple to make.

The string 10, which may be from a spool of thread, is secured to the flagging in the slack portion, about two thirds of the length from the anchor strip 11, by a few wraps around the flagging and tying a knot. On the usual food container as herein referred to, a projection as 14 is provided as a means for opening the container.

The box top having a peripheral lip 2 is particularly adaptable to this kite building, the lip giving more strength to the top, so that it will retain its shape in high winds, and the projection 14 on the lip 2, that is provided for easy opening of the box (not shown), provides an aerodynamic foil that enhances the flight of the kite, as well as providing stability. The box top of the type referred to, has two longitudinal slots in one longitudinal peripheral lip as 12, 12, which are the receiving slots forming hinges on the food container, and one slot 3, through which the tail is passed, aids in centering the tail, and the top slots help guide the wrapping of the flagging around the center of the box top, and assuring centering of the bridal formed by the slack portion of flagging. The point of joinder of the long tail and the pig tail is thus at a position of strength on the box top, and by anchoring the tail on the back side of the box top, adjacent this slot, the kite's angle of elevation, in flight, is improved, and stability is provided to the action of the kite in flight. The anchor points 7, 7 maintain the tail and the pig tail at the selected lengths.

Many food containers are formed with a top substantially the same as the one shown herein. By practicing the method herein taught of wrapping a ribbon, such as the flagging described, around the box top, and leaving a tail and a pig tail, as described, when anchoring the ribbon to the box top, and leaving slack in the wrap on the box top surface opposite that where the tail and pig tail are anchored, and securing a string end to the said slack portion, about two-thirds of the length of the ribbon on said side, and adjacent the margin of the box top opposite the tail anchor point, will provide an inexpensive easily assembled kite.

What I claim is:

1. In a kite, a substantially rectangular member of light rigid material, flagging mounted on said member midway of the ends thereof so that said flagging wraps around the upper and lower surfaces of said member, said flagging being secured adjacent the peripheral margins on one of said surfaces, and adjacent one peripheral margin of the other surface of said surfaces, and a string attached to said flagging adjacent the peripheral margin opposite said one peripheral margin of said other surface.

2. The device defined in claim 1 wherein said member has a peripheral margin projection extending from one surface thereof.

3. The device defined in claim 1 wherein said member has a projection along one of said peripheral margins, and a longitudinal slot formed in said projection midway of the ends of said member.

4. The device defined in claim 1 wherein said member is a box top, and said flagging being anchored thereon, with the flagging forming a tail and a pig tail of unequal lengths and the flagging anchored on the surface opposite said tail and pig tail with a slack portion forming a bridle, and said string secured to said bridle.

5. The method of making kites comprising removing the top from a substantially rectangular plastic foam container, forming a tail and a pig tail of unequal lengths by folding over about one sixth of a length of Engineer's flagging at one end and securing said flagging to said top at points adjacent the peripheral edges of one surface of said top wrapping the flagging around the top midway of the edges of said top and securing said flagging on the opposite surface of the top adjacent the edge from which the tails depend, leaving a slack in the flagging and fastening one end of the thread of a spool of thread to the slack portion of the flagging.

* * * * *